United States Patent [19]

Oka et al.

[11] Patent Number: 4,954,843

[45] Date of Patent: Sep. 4, 1990

[54] ELECTROPHOTOGRAPHIC IMAGE FORMING APPARATUS

[75] Inventors: Tateki Oka; Naoki Toyoshi; Kunio Toda, all of Osaka, Japan

[73] Assignee: Minolta Camera Kabushiki Kaisha, Osaka, Japan

[21] Appl. No.: 355,690

[22] Filed: May 23, 1989

[30] Foreign Application Priority Data

| | | | |
|---|---|---|---|
| May 24, 1988 | [JP] | Japan | 63-127797 |
| May 24, 1988 | [JP] | Japan | 63-127798 |
| Apr. 11, 1989 | [JP] | Japan | 64-92483 |
| Apr. 11, 1989 | [JP] | Japan | 64-42696[U] |

[51] Int. Cl.[5] ..... G03G 15/06; G03G 15/02

[52] U.S. Cl. ..... 355/210; 355/225; 355/266; 355/268; 346/153.1

[58] Field of Search ..... 355/210, 225, 266, 268; 346/153.1, 160

[56] References Cited

U.S. PATENT DOCUMENTS

| | | | |
|---|---|---|---|
| 3,967,891 | 7/1976 | Rippstein | 355/239 |
| 4,794,062 | 12/1988 | Oka et al. | 430/31 |
| 4,821,076 | 4/1989 | Toyoshi et al. | 355/268 X |

FOREIGN PATENT DOCUMENTS 54-30833 3/1979 Japan .

*Primary Examiner*—Joan H. Pendegrass

*Attorney, Agent, or Firm*—Burns, Doane, Swecker & Mathis

[57] ABSTRACT

An image forming apparatus wherein a photosensitive layer arranged to rotate in one direction is charged by a charger, and a negative electrostatic latent image is formed thereon by an exposure unit and then is subjected to reversal development by a developing device so that a positive noticeable image can be attained. The apparatus has a scorotoron charger for charging the negative latent image which has just been formed by the exposure unit with the opposite polarity thereof. A grid of the scorotoron charger is constituted to be impressed with a voltage with the same polarity as the latent image and a value lower than that of the surface potential, and by the scorotoron charger, the potential of the non-imaged portions of the latent image is lowered around the grid voltage. Further, the developing device is constituted to be impressed with a developing bias voltage with the same polarity as the latent image and a value lower than that of the surface potential but higher than a developing threshold value, whereby toner charged with the same polarity as that charged by the charger sticks to the imaged portions with potential lower than the developing bias voltage, resulting in a positive toner image with sharp line widths.

30 Claims, 11 Drawing Sheets

ELECTROPHOTOGRAPHIC IMAGE FORMING APPARATUS

BACKGROUND OF THE INVENTION

1. Field of the Invention

The present invention relates to an image forming apparatus, more specifically, an image forming apparatus wherein an image is formed by electrophotographic processing.

2. Description of Related Art

In general electrophotographic processing wherein a laser beam or an LED is utilized as a print head, an image development is based on the principle of reversal development because an electrostatic latent image is formed as a negative document's image.

In such electrophotographic processing, as shown in FIG. 14*a*, an image is exposed to a photosensitive layer with surface potential (Vo) by said print head to form a negative electrostatic latent image, and thereafter with a developing bias of potential (Vb) impressed on a developing sleeve, the reversal development is performed by a developer composed of two elements. As a result, toner sticks to the parts shown by oblique lines in FIG. 14*a*, and a positive toner image can be formed. Image widths a and a' to be reproduced at that time almost correspond to the cross sectional widths of the developing bias potential (Vb).

Recently, in reproducing images, quality and accuracy are intended to be regarded more, so that an electrophotographic printer which can reproduce images with narrow and sharp line widths is required. As mentioned above, however, In the way that the developing bias of potential (Vb) almost equal to the initial surface potential (Vo) of the photosensitive layer is impressed, the image widths a and a' are large by all means, and it is difficult to sharpen line images.

As a measure to cope with the drawback, first, the diameter of the beam from the print head should be reduced, but this may result in an increase of cost and therefore this is not a desirable measure. Also, if the diameter of the beam is reduced, such side effects as a lag of mechanical system, uneven drive, etc. which may affect images will occur.

On the other hand, to attain narrow line widths by any treatment in processes after the image exposure, as shown in FIG. 14*b*, it will be possible to gain the difference between the developing bias potential (Vb) and the surface potential (Vo). FIG. 14*b* shows an example that the developing bias potential (Vb) is largely lowered. Thereby, image widths b and b' to be reproduced become narrower than the image widths a and a' shown in FIG. 14*a* although they are the same latent images. Taking this way when using a developer composed of carriers and toner, however, will cause a problem that the carriers charged with the polarity (positive polarity in FIG. 14*b*) opposite to the surface potential (Vo) stick to non-imaged portions with high potential. The deposition of the carriers on the photosensitive layer will cause such inconveniences as poor transference, the occurrence of flaws of the photosensitive layer at a cleaning section, uneven development on account of the loss of the developer in a developing device, etc. Such inconveniences are obvious when small diameter carriers are used in order to improve quality of images or when binder type carriers wherein magnetic powder is spread among resin are used.

If the initial surface potential (Vo) is reduced synchronized with the reduction of the developing bias potential (Vb), as shown in FIG. 14*c*, the difference between the potential (Vo) and the potential (Vb) will not become larger, and accordingly the deposition of the carriers on the non-imaged portions will not occur. However, image widths c and c' shown in FIG. 14*c* are larger than the image widths b and b' and almost as large as the image widths a and a' shown in FIG. 14*a*, the ones before taking a measure.

SUMMARY OF THE INVENTION

It is, therefore, an object of the present invention to provide an image forming apparatus wherein without the necessity of largely reducing a beam diameter of a print head, narrow and sharp image widths can be reproduced with the deposition of carriers prevented by treatment in processes after the image exposure.

Another object of the present invention is to provide an image forming apparatus wherein the deposition of carriers and the superfluous deposition of toner on an electrostatic latent image bearing member can be effectively prevented, and sharp images can be reproduced.

To attain the above objects, an image forming apparatus according to the present invention is composed of the following elements: an electrostatic latent image bearing member which is arranged to rotate in one direction; charging means for charging the surface of the electrostatic latent image bearing member with specified surface potential and polarity; latent image forming means for forming a negative electrostatic latent image, which consists of non-imaged portions with the potential equal to the specified surface potential and imaged portions with substantially lower surface potential, on the surface of the electrostatic latent image bearing member which was charged with the specified surface potential by the charging means; a scorotoron charger for charging the surface of the electrostatic latent image bearing member on which an electrostatic latent image has just been formed with the polarity opposite to that charged by the charging means in order to reduce the surface potential of the non-imaged portions, with its grid impressed with a voltage with the same polarity as that charged by the charging means and a value lower than that of the surface potential of the non-imaged portions; and developing means for performing reversal development of the electrostatic latent image passed the scorotoron charger with use of toner charged with the same polarity as that charged by the charging means, with its developing electrode impressed with a developing bias voltage with the same polarity as that charged by the charging means and a value lower than that of the surface potential of the non-imaged portions but higher than a developing threshold value.

That is, with the above constitution, a negative latent image is formed by the latent image forming means on the surface of the electrostatic latent image bearing member which was charged with the specified potential by the charging means. Thereafter, the latent image is charged by the scorotoron charger with the polarity opposite to that charged by the charging means. In this moment, the grid of the scorotoron charger is impressed with a voltage with the same polarity as that charged by the charging means and a value lower than that of the surface potential of the non-imaged portions. Thereby, the potential of the non-imaged portions is lowered around the grid potential. Next, the latent image is subjected to the reversal development with use of toner charged with the same polarity as that charged by the charging means. At that time, the developing electrode is impressed with a developing bias voltage with the same polarity as the grid voltage and a value higher than the developing threshold value. Thereby, the charged toner sticks to the imaged portions with potential lower than the developing bias voltage, so that a positive toner image can be attained.

In the present invention, an electrostatic latent image formed by the latent image forming means is developed after it is adjusted by the scorotoron charger. By the time of development, the surface potential of the non-imaged portions has been lowered around the grid voltage, and the image widths of the imaged portions to which toner is going to stick can be narrower by designing the developing bias voltage to be lower than a conventional value. Also, the difference between the surface potential of the non-imaged portions and the developing bias voltage is so small that the deposition of carriers does not occur.

An image forming apparatus according to the present invention will be preferable if said electrostatic latent image bearing member comprises a photosensitive layer, and said latent image forming means is an irradiating unit for forming a negative electrostatic latent image, whose imaged portions have substantially lower surface potential, by irradiating the surface of the photosensitive layer. It is preferred that a power source unit is common to devices whose impressed voltages have the same polarity; for example, the grid of the scorotoron charger and the developing electrode of the developing means are arranged to be impressed with voltages of specified potential by a single power source unit.

Also, an image forming apparatus according to the present invention comprises first control means for controlling the operation of the charging means, second control means for controlling the operation of the scorotoron charger and third control means for controlling the second control means to drive the scorotoron charger a specified time after the charging means was driven by the first control means, as well as the electrostatic latent image bearing member, the charging means, the latent image forming means, the scorotoron charger and the developing means. The specified time is shorter than the time required for a part of the surface of the electrostatic latent image bearing member to rotate from the position where it is charged by the charging means to the position where it is charged by the scorotoron charger.

Further, in an image forming apparatus according to the present invention, it is preferred that the grid of the scorotoron charger is composed of a plurality of wires aligned at a specified pitch and that the proximate distance (Dg) between the grid and the surface of the electrostatic latent image bearing member and the wire pitch (Mp) of the grid fulfill the following conditions:

$$Dg \leqq 0.8 \text{ mm}$$

$$0.25 \text{ mm} < Mp \leqq 1.25 \times Dg$$

It is also preferred that the developing bias voltage to be impressed on the developing electrode of the developing means corresponds to the surface potential of the photosensitive layer which will be attained if the photosensitive layer is irradiated at a certain quantity of light higher than the value of approximately two seventh of the specified exposure value, referring to the characteristic curve showing the relation between the surface potential of the photosensitive layer and the quantity of light irradiated from the irradiating means based on a photoinduced discharge characteristic of the photosensitive layer.

BRIEF DESCRIPTION OF THE DRAWINGS

These and other objects and features of the present invention will become apparent from the following description taken in conjunction with the preferred embodiments thereof with reference to the accompanying drawings.

The drawings show embodiments of image forming apparatuses according to the present invention.

DETAILED DESCRIPTION OF THE PREFERRED EMBODIMENTS

Figure 1:
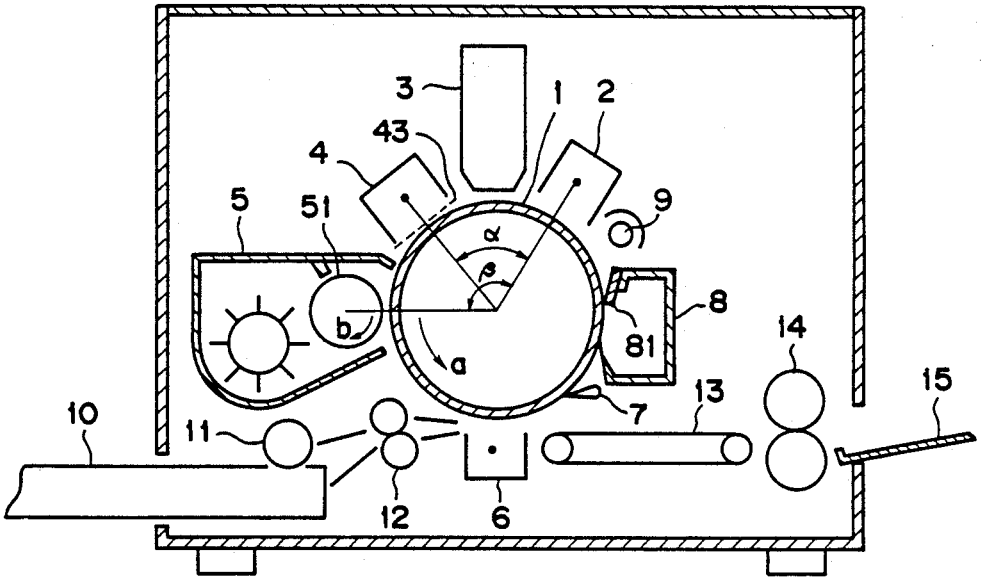
FIG. 1 is a schematic view of a first embodiment of an image forming apparatus according to the present invention showing its general constitution.

The description of embodiments of an image forming apparatus according to the present invention is given below. Further, same numerals in the drawings show the common parts.

[First Embodiment: refer to FIGS. 1 through 7]

A photosensitive drum 1 shown in FIG. 1, which has a photoconductive layer on its circumferential surface, is a conventional one and can be driven to rotate in the direction of the arrow a. Around the photosensitive drum 1, the following image forming devices are arranged along the direction of the rotation of the photosensitive drum 1.

Electric Charger 2:

This charges the surface of the photosensitive drum 1 with specified surface potential, and its charge wire is connected to a power source not shown in the drawings.

Print Head 3:

This is composed of LEDs arranged in a line, and each of the LEDs is turned on and off in response to an image signal outputted from a drive circuit not shown in the drawings. When some of the LEDs in the part corresponding to an imaged portion are turned on, in that part, the surface potential of the photosensitive drum 1 which was given by said electric charger 2 is lowered, and thus a negative electrostatic latent image consisting of non-imaged portions with the specified surface potential and imaged portions with substantially lower potential is formed.

Figure 2:
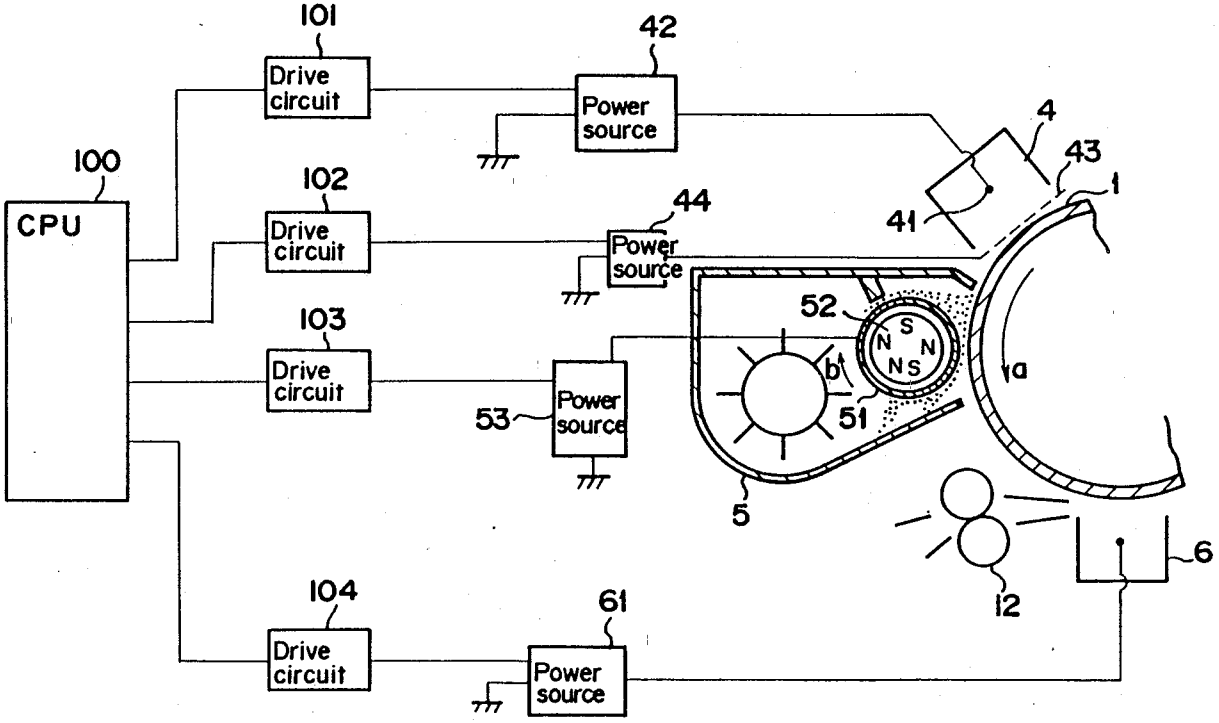
FIG. 2 shows the constitution of the principal part of the apparatus shown in FIG. 1, including a control circuitry.

Scorotoron Charger 4:

This is arranged to adjust the electrostatic latent image formed by the print head 3 before it is subjected to development. As shown in FIG. 2, a charge wire 41 is connected to a power source 42, and a grid 43 is connected to a power source 44. The power source 42 impresses the charge wire 41 with a voltage with the polarity opposite to that charged by the electric charger 2, and the power source 44 impresses the grid 43 with a voltage with the same polarity as that charged by the electric charger 2 and a value lower than that of the surface potential of the non-imaged portions of the electrostatic latent image.

Developing Device 5:

This is according to the known magnetic brushing principle, which comprises a developing sleeve 51 functioning as developer carrying means and a developing electrode. As shown in FIG. 2, the developing sleeve 51 which incorporates a magnet roller 52 can be driven to rotate in the direction of the arrow b, and it is connected to a power source 53 in order to be impressed with a developing bias. The developer is a mixture of magnetic carriers and insulative toner, and the toner and the carriers are charged so as to have the same polarity as and the polarity opposite to that charged by the electric charger 2 respectively on account of the frictional electrification between them. The power source 53 impresses the developing sleeve 51 with a developing bias with the same polarity as that of the grid voltage. The voltage of the developing bias, when non-magnetic insulative toner is used, is slightly lower than the grid voltage. When using magnetic insulative toner, the voltage of the developing bias may be equal to the grid voltage or higher. In this case, an AC voltage can be superimposed on the developing bias. The detailed description of these will be given later.

Transfer Charger 6:

This provides a passing sheet of copying paper sticking to the bottom of the photosensitive drum 1 with an electrostatic field to transfer the toner image formed by the developing device 5 onto the sheet. A power source 61 impresses its charge wire with a voltage with the polarity opposite to that of the insulative toner.

Separation Click 7:

This is slightly in contact with the surface of the photosensitive drum 1 and removes the copying paper onto which the image has been transferred from the photosensitive drum 1.

Cleaning Device 8:

This comprises a blade 81 for removing the residual toner from the surface of the photosensitive drum 1.

Eraser Lamp 9:

This removes the residual charge from the surface of the photosensitive drum 1 by lighting.

On the other hand, copying paper which has been stored in an automatic feeding cassette 10 is fed out sheet by sheet starting with the uppermost sheet by the rotation of a feeding roller 11 and fed to a transfer section by a timing roller 12 at a specified timing. After the transferring operation, the copying paper is fed to a fixing device 14 by a conveyer belt 13 comprising air suction means (not shown in the drawings) to be subjected to the fixation of the toner image and then ejected onto an ejection tray 15.

A printer constituted as described above is controlled with a system lead by a microcomputer 100 shown in FIG. 2. Regarding a power source section, drive circuits 101 and 102 turning on and off the power sources 42 and 44 connected to the charge wire 41 of the scorotoron charger 4 and the grid 43 respectively are connected to the microcomputer 100. Further, a drive circuit 103 turning on and off the power source 53 for impressing the developing bias and a drive circuit 104 turning on and off the power source 61 connected to the charge wire of the transfer charger 6 are connected to the microcomputer 100.

The polarity and the impressed voltage of each charger and device in this first embodiment are herewith shown.

photosensitive drum:
  OPC (organic photoconductor)
  negative charge
system speed:
  100 mm/sec.
electric charger (power source 21):
  negative −5.5 kV
scorotoron charger (power source 42):
  positive +6.0 kV
grid voltage (power source 44):
  negative −600 V
  grid wire pitch 0.7 mm
  proximate distance to the surface of the photosensitive
  drum 0.8 mm
developing bias (power source 53):
  negative −450 V
transfer charger (power source 61):
  positive +6.0 kV
insulative toner:
  insulative non-magnetic resin binder type
  negative Further, it should be noticed that the polarity may be all reverse and that the values of the voltages are just examples.

The description of the image forming method with use of the printer with the above described composition is given below step by step.

(i) Charging process

The electric charger 2 charges the surface of the photosensitive drum 1 with specified potential (Vo). In the first embodiment, the initial surface potential (Vo) is −800 V.

(ii) Exposing Process

The LEDs of the print head 3 light up the surface of the photosensitive drum 1 charged with −800 V and erase the charge according to the information on an image, thereby forming an electrostatic latent image thereon. The electrostatic latent image is formed as a negative image; in FIG. 3*a*, the parts shown by "A"s are imaged portions (exposed portions) and the parts shown by "B"s are non-imaged portions (unexposed portions). The surface potential of the imaged portions A is lowered to −100 V.

(iii) Recharging (Latent Image Adjusting) Process

Figure 3A:
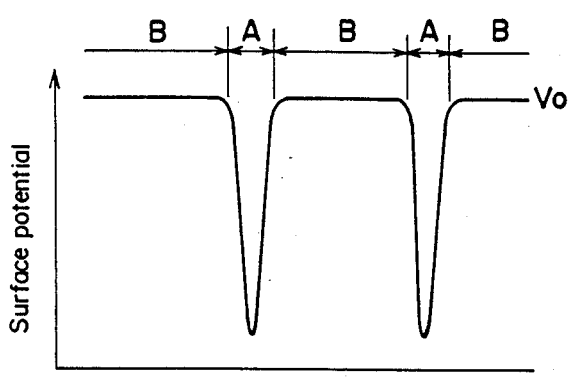
FIGS. 3*a*, 3*b* and 3*c* are charts showing the surface potential of a photosensitive layer in respective image forming processes.
Figure 3B:
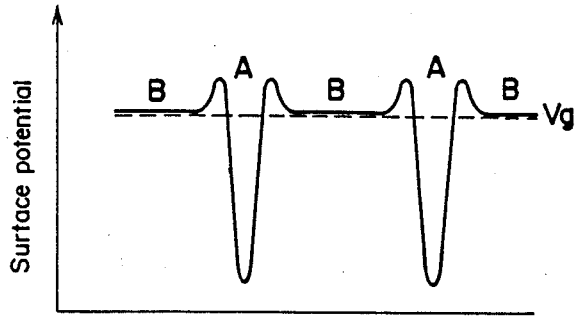
Figure 4:
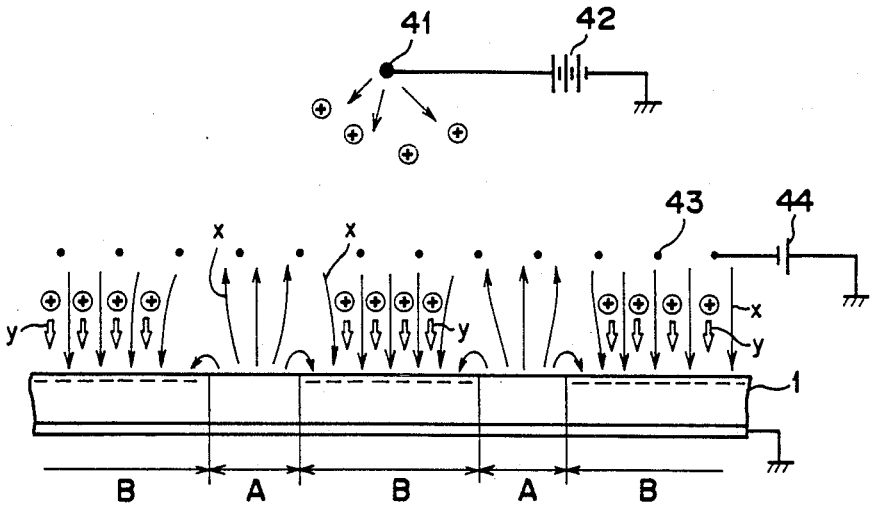
FIG. 4 is a diagram showing electric lines of force in a recharging (latent image adjusting) process.

The surface of the photosensitive drum 1 on which an electrostatic latent image was formed in said process (ii) is provided with positive electric charge by the scorotoron charger 4. In this moment, the charge wire 41 is impressed with a high voltage of +6.0 kV, and the grid 43 is impressed with a voltage of −600 V. At that time, an electrostatic field as schematically shown by FIG. 4 is formed between the surface of the photosensitive drum 1 and the grid 43. Positive ions produced by the charge wire 41 are provided with transporting force in the directions along electric lines of force shown by the arrows x in the figure. In this case, the electric lines of force which have the positive ions go toward the surface of the photosensitive drum 1 are produced only in the non-imaged portions B. Accordingly, the positive ions reach only the non-imaged portions B as shown by the arrows y and erase the charge on the portions to lower the potential around −600 V almost equal to the grid voltage (Vg). The distribution of the surface potential in this moment is shown by FIG. 3*b*.

At edge portions in the neighborhood of the borders between the non-imaged portions B and the imaged portions A, electric lines of force are formed into circular arcs. As these electric lines of force do not function to have the positive ions go toward the surface of the photosensitive drum 1, the positive ions can not reach the surface of the photosensitive drum 1, and the surface potential is not lowered so much. As a result, as shown in FIG. 3*b*, the potential around the edge portions remains slightly higher. In order to decrease the portions with higher potential at the edge portions, the distance between the grid 43 and the surface of the photosensitive drum 1 should be reduced to narrow the area where the electric lines of force shaped in circular arcs are formed. In the first embodiment, the proximate distance between the grid 43 and the surface of the photosensitive drum 1, as mentioned above, is designated 0.8 mm, comparatively short. Further, the detailed description of this point will be given later.

(iv) Developing Process

Figure 3C:
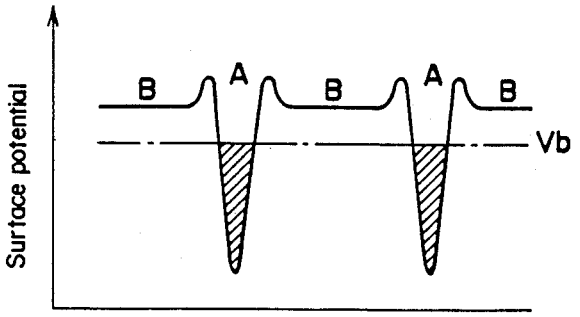

The electrostatic latent image adjusted in said process (iii) is subjected to the reversal development by the developing device 5. In the first embodiment, non-magnetic insulative toner charged with the negative polarity is used, and the developing sleeve 51 is impressed with a developing bias of −450 V. In this moment, the toner charged with the negative polarity, as shown in FIG. 3*c*, sticks to the portions with lower potential than the developing bias voltage (Vb), that is, the imaged portions A, and thus a positive image is formed. The developing bias voltage (Vb) of −450 V at the time of development is enough low compared with the initial surface potential (Vo) of −800 V, so that the narrow image widths can be reproduced as initially projected.

The difference between the surface potential (−600 V) of the non-imaged portions B and the potential (−450 V) of the developing bias is small, about 150 V, so that the carriers can not stick to the non-imaged portions B. The edge portions of the non-imaged portions B is considered to remain with slightly higher potential, but each of the edge portions is too narrow to form such a strong electrostatic field as attracts the carriers. On the contrary, the potential difference is so large that the toner charged with the negative polarity can not stick to the non-imaged portions B, and therefore there is no fear of superfluous deposition of the toner.

On the other hand, when using magnetic insulative toner, the developing bias voltage (Vb) may be almost equal to the grid voltage (Vg) or higher. In this case, the DC developing bias is superimposed with an AC voltage. Magnetic toner has a certain threshold value on account of its magnetically binding action. For this reason, even under the condition, $Vg<Vb$ (potential deference of several decades volts at dc component), the development is actually started at portions with lower potential than the developing bias voltage, so that neither the superfluous deposition of the toner nor the deposition of the carriers on the non-imaged portions occur.

Further, as a comparison experiment, the image forming was performed with use of said printer under the same conditions except that the scorotoron charger 4 was not operated. On examination the reproduced images had narrow line widths as projected, but there were found black dots caused by the deposition of the carriers and partly found defective transference which might be caused by the deposition of the carriers. The following can be conjectured: the narrow image widths could be reproduced because the developing bias voltage (Vb) was enough low compared with the initial surface potential (Vo); the deposition of the carriers occurred on account of the comparatively large potential difference between (Vo) and (Vb), 350 V.

Figure 5:
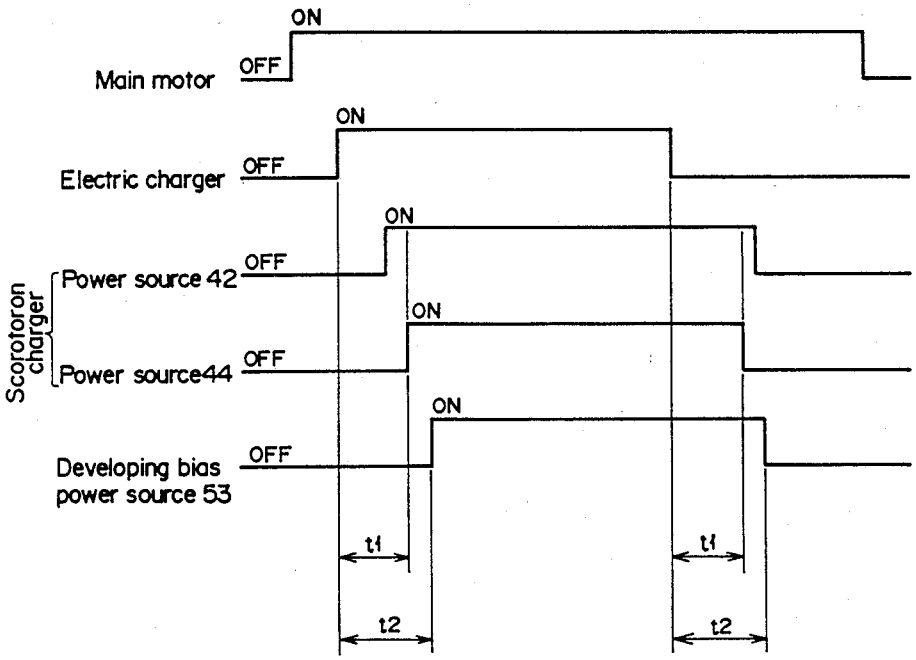
FIG. 5 is a timing chart showing an image forming process.

The operational timing of each power source at the time of executing each process of the above four is hereinafter described referring to a timing chart in FIG. 5.

First, a main motor is driven to start rotating the photosensitive drum 1, and after a specified time, a high voltage source (not shown in the drawings) of the electric charger 2 is turned on to start charging. When a time t1 elapses, the power source 44 of the grid 43 of the scorotoron charger 4 is turned on to impress the grid 43 with the specified voltage. The time t1 is the time required for the photosensitive drum 1 to make a turn of an angle $\alpha$ made by the installation of the electric charger 2 and the scorotoron charger 4. That is, when a part of the photosensitive drum 1 charged with the surface potential (Vo) by the electric charger 2 reaches the scorotoron charger 4, the scorotoron charger 4 is started operating.

Further, the high voltage source 42 which supplies the charge wire 41 with high voltage current should be turned on slightly before the time tl elapses. Even if the charge wire 41 is impressed with a high voltage when the grid power source 44 is off, the surface potential of the photosensitive drum 1 is not affected. Further, the power source 44 of the grid 43 do not have to be turned on when the time t1 elapses, and it should be turned on at least before the time t1 elapses. Even if it is turned on in advance, the surface of the photosensitive drum 1 is not affected at all because only an uncharged part of the photosensitive drum 1 passes the scorotoron charger 4 until the time t1 elapses. Also, the power sources 42 and 44 can be turned on at the same time, or the power source 44 can be turned on earlier, and the power source 42 is turned on when the time t1 elapses. In short, if the scorotoron charger 4 is started operating with its grid 43 impressed with the voltage (Vg) within the time t1 after the electric charger 2 was started operating, an object of the present invention can be attained. On the contrary, if the scorotoron charger 4 is started operating later than the time t1, the part of the photosensitive drum 1 passing through the scorotoron charger 4 for the time lag will reach the developing section with the surface potential remaining (Vo), resulting in the deposition of the carriers thereon as described above.

Next, when a time t2 elapses after the electric charger 2 was started operating, the power source 53 of the developing bias is turned on. The time t2 is the time required for the photosensitive drum 1 to make a turn of an angle $\beta$ made by the installation of the electric charger 2 and the developing device 5. That is, when a part of the photosensitive drum 1 whose surface potential was lowered to about the grid voltage (Vg) reaches the developing section, the impressIon of the developing bias is started, and the development is started. If the developing bias is impressed before the time t2 elapses, the toner sticks to the uncharged part of the surface of the photosensitive drum 1, and if the developing bias is impressed with delay, the toner sticks to the part passing through for the time lag because of the potential difference between the surface potential of about (Vg) and the developing bias of 0 V.

Regarding the stoppage of the operation, the power source 44 is turned off when the time t1 elapses after the electric charger 2 was stopped operating, and with a slight time lag, the power source 42 is turned off. This arrangement is made in order to attain an object that at all the parts, the surface potential (Vo) of the photosensitive drum 1 is lowered around the grid voltage (Vg). Further, it is apparent from the above explanation that the time lag should be at least the time t1. If the operation is stopped before the time t1 elapses, the part with surface potential (Vo) will reach the developing section as it is, causing the deposition of the carriers on the part.

When the time t2 elapses after the electric charger 2 was stopped operating, the power source 53 of the developing bias is turned off. The reason can be explained in the same manner as the case of starting the operation.

The image forming conditions as described above are designated by the inventors as the most preferable conditions. Further, various experiments of this system on the distance between the wire pitch of the grid 43 of the scorotoron charger 4 and the photosensitive drum 1 for the improvement of images were made under the above-described conditions, and the following resulted.

Figure 6:
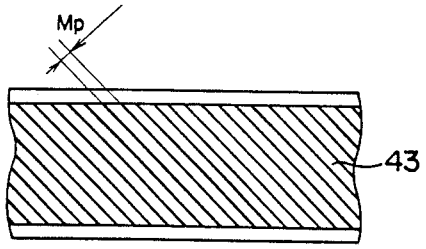
FIG. 6 is a magnified plan view showing grid wires of a scorotoron charger.

As shown in FIG. 6, a stainless sheet of 0.1 mm thickness processed by the etching processing was utilized as the grid 43 in the experiments. A wire pitch (Mp) means the pitch between the wires neighboring with each other, and the width of each wire itself is 0.1 mm. A distance (Dg) between the grid wire and the photosensitive drum 1 means the proximate distance between the grid 43 and the photosensitive layer.

In each of the experiments wherein grids with wire pitches (Mp) of 0.25 mm, 0.5 mm, 0.7 mm, 1.1 mm and 1.4 mm were used respectively, the image forming operation was performed under the same conditions as described above altering the distance (Dg) between the grid and the photosensitive layer to 0.4 mm, 0.6 mm, 0.8 mm, 1.0 mm and 1.2 mm. Formed images were examined whether their line widths are smaller than 270 $\mu$m corresponding to 4-dot line width in 400 dot/inch and whether the deposition of carriers and the superfluous deposition of toner occur.

Figure 7:
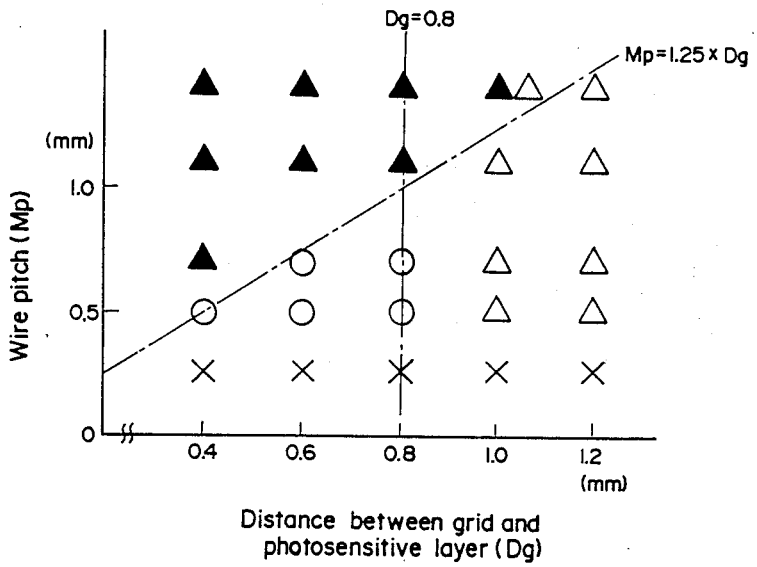
FIG. 7 is a graph showing the results of image forming experiments wherein the distance between the grid and the photosensitive layer and the wire pitch of the grid are altered.

FIG. 7 shows the results; a circle is given when the image forming operation resulted in preferable images whose line widths are smaller than the projected value (270 $\mu$) without the occurrence of the deposition of carriers and the superfluous deposition of toner; a triangle is given when the line widths of formed images are smaller than the projected value with the occurrence of the slight deposition of carriers in the peripheral parts of the imaged portions; a thickened triangle is given when the line widths of formed images are smaller than the projected value with the occurrence of the superfluous deposition of toner on the non-imaged portions; an X is given when the line widths of formed images are above the projected value with the occurrence of the deposition of carriers on the non-imaged portions.

The following can be reasoned from the results.

(1) Under the condition of $Mp \leqq 0.25$ mm, the wire pitch is too small to provide the scorotoron charger 4 with enough power for charging, so that the surface potential of the non-imaged portions can not be lowered to the grid voltage (Vg), whereby the surface potential of the non-imaged portions remains high.

(2) Under the condition of $Mp > 1.25 \times Dg$, ions produced from the charge wire 41 can not be controlled well by the grid wire because (Mp) is larger than (Dg), whereby the rate of the ions which reach the surface of the photosensitive layer becomes larger. Accordingly, the surface potential of the non-imaged portions which was charged by the scorotoron charger 4 becomes lower than the grid voltage (Vg: −600 V), and the potential difference between the surface potential and the developing bias voltage (Vb: −450 V) becomes smaller, causing the occurrence of the superfluous deposition of toner.

(3) Under the condition of $Dg > 0.8$ mm, arc shaped electric lines of force formed around the edge portions of the imaged portions A shown in FIG. 4 increase in number because the distance (Dg) becomes larger. That is, the potential of the edge portions becomes slightly higher, causing the occurrence of the deposition of carriers thereon.

It can be concluded based upon the results and the examinations as described above that under the condition of $$Dg \leqq 0.8 \text{ mm and}$$

$$0.25\ mm < Mp \leqq 1.25 \times Dg,$$

with use of the printer according to the present invention, sharp images with narrow line widths can be formed without any side effects such as the deposition of carriers and the superfluous deposition of toner.

[Second Embodiment; refer to FIGS. 8 through 11]

Figure 8:
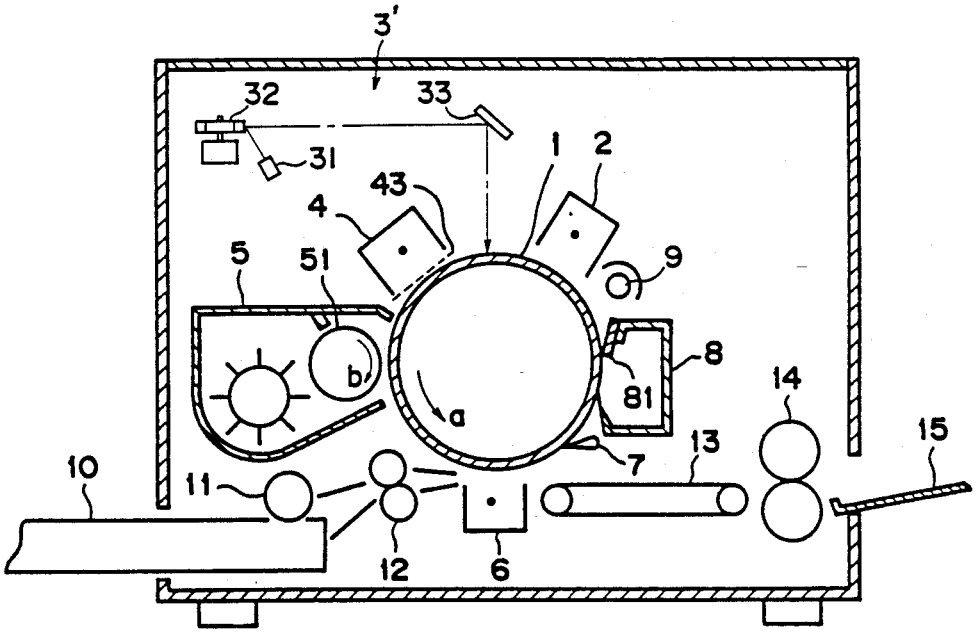
FIG. 8 is a schematic view of a second embodiment of an image forming apparatus according to the present invention showing its general constitution.

FIG. 8 shows a general constitution of an apparatus; a printer as a second embodiment of the present invention has the same constitution as the printer of the first embodiment, except that a laser beam optical system 3' is used instead of the print head 3 in the first embodiment. The laser beam optical system 3' comprises a laser diode 31, a polygon mirror 32, a reflector 33, etc. The laser diode 31 is turned on and off in response to an image signal outputted from a drive circuit not shown in the drawings. A laser beam emitted from the laser diode 31 which was turned on radiates to the surface of the photosensitive drum 1 with use of the polygon mirror 32 and lowers its surface potential charged by the electric charger 2, and thus a negative electrostatic latent image consisting of non-imaged portions with the specified surface potential and imaged portions with substantially lower surface potential is formed.

Figure 9:
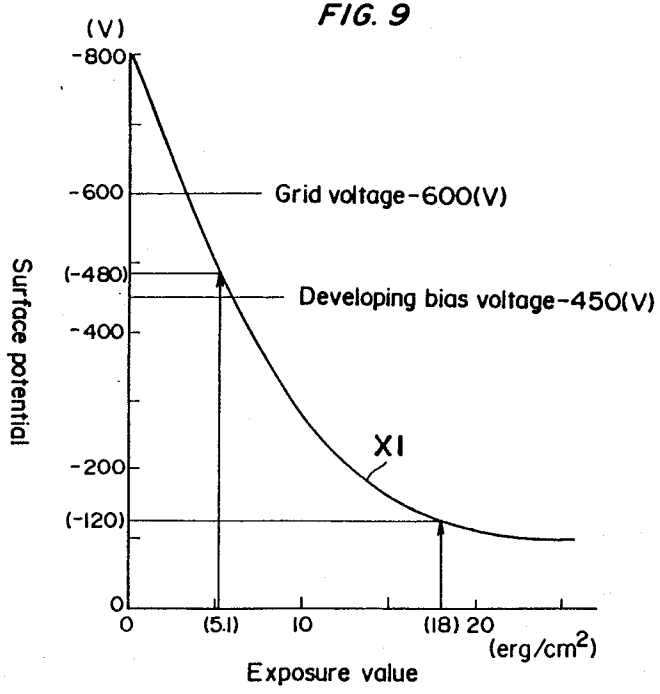

The description of image forming experiments made with use of the printer according to the second embodiment is hereinafter given. The image forming conditions are basically the same as those of the first embodiment, and the laser diode 31 has a wave length of 780 mm and an exposure value of 18 erg/cm$^2$ (the measured value on the surface of the photosensitive layer corresponding to the most thickened imaged part). A photoinduced discharge characteristic of the photosensitive layer is shown by the curve X1 in FIG. 9. The grid 43 of the scorotoron charger 4 has a wire pitch (Mp) of 0.75 mm. The other image forming conditions and processes are the same as those of the first embodiment. Further, in the second embodiment, since the exposure value of the laser diode 31 (the biggest exposure value corresponding to the socalled wholly black) in an exposure process is designated 18 erg/cm$^2$, the lowest surface potential of imaged portions A, shown by the graph in FIG. 9, is lowered to about −120 V corresponding to the exposure value of 18 erg/cm$^2$.

According to the image forming experiments with use of the printer of the second embodiment, images with sharp line widths can be formed the same as a case of using the printer of the first embodiment, and further the following resulted from various experiments made by the inventors for the improvement of images to be formed by this system.

(1) Altering the Exposure Value of the Laser Beam Optical System 3':

With use of the printer wherein the initial surface potential is −800 V, and the difference between the grid voltage (Vg) and the developing bias voltage (Vb) is 150 V, an experiment that the exposure value of the laser beam optical system 3' is altered step by step as shown in Table 1 was made. Then, formed images in each case were examined whether their line widths are smaller than 270μm corresponding to 4-dot line width in 400 dot/inch.

TABLE 1

| Developing Bias Voltage (V) | Exposure Value (erg/cm$^2$) 15 | 18 | 21 | 24 | 27 | 30 |
|---|---|---|---|---|---|---|
| −500 | | X | X | X | X | X |
| −450 | | | X | X | X | X |
| −400 | | | | | X | X |
| −350 | | | | | | X |
| −300 | | | | | | |

In Table 1, a circle is given when the line widths of the formed images are smaller than the projected value (270 μm), and an X is given when they are above the projected value, (2) Setting the Initial Surface Potential Differently:

With use of the same printer as used in (1), the image forming operation was performed with the initial surface potential (Vo) at −1000 V, altering the exposure value of the optical system 3' step by step, and thus formed images were examined. Further, the photoinduced discharge characteristic of the photosensitive layer in a case of its surface potential at −1000 V is shown by the curve X2 in FIG. 10.

TABLE 2

| Developing Bias Voltage (V) | Exposure Value (erg/cm$^2$) 15 | 18 | 21 | 24 | 27 | 30 | 33 |
|---|---|---|---|---|---|---|---|
| −600 | | X | X | X | X | X | X |

TABLE 2-continued

| Developing Bias Voltage (V) | Exposure Value (erg/cm$^2$) 15 | 18 | 21 | 24 | 27 | 30 | 33 |
|---|---|---|---|---|---|---|---|
| −550 | | | | X | X | X | X |
| −500 | | | | | X | X | X |
| −450 | | | | | | X | X |
| −400 | | | | | | | |
| −350 | | | | | | | |
| −300 | | | | | | | |

In Table 2, a circle and an X are given when the line widths of the formed images are respectively below and above the projected value.

Figure 10:
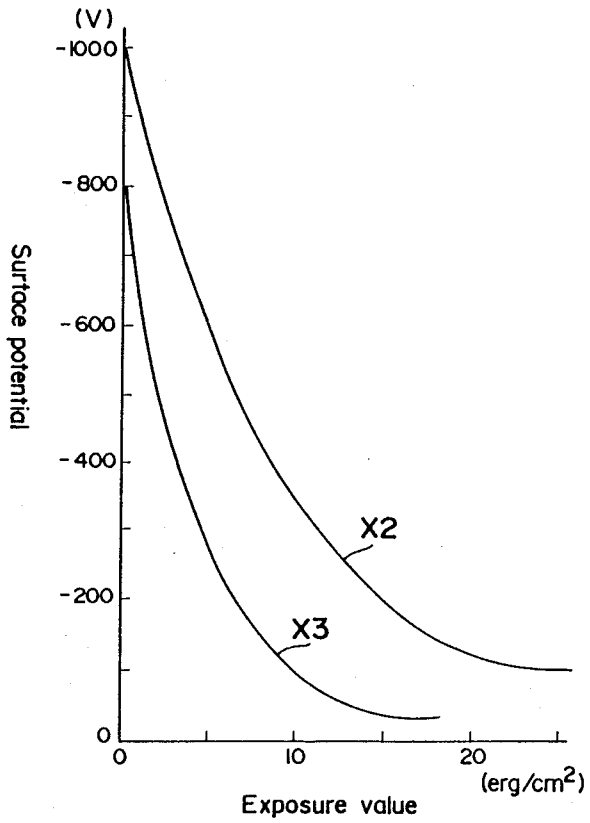
FIGS. 9 and 10 are graphs showing a photoinduced discharge characteristic of the photosensitive layer.

(3) Using a Photosensitive Layer with a Different Photoinduced Discharge Characteristic:

With use of the same printer as used in (1) and (2) wherein a photosensitive layer with the photoinduced discharge characteristic shown by the curve X3 in FIG. 10 is utilized, the image forming operation was performed with the exposure value altered step by step as performed in (1), and thus formed images were examined.

TABLE 3

| Developing Bias Voltage (V) | Exposure Value (erg/cm$^2$) 9 | 12 | 15 | 18 | 21 |
|---|---|---|---|---|---|
| −500 | X | X | X | X | X |
| −450 | | X | X | X | X |
| −400 | | X | X | X | X |
| −350 | | | | X | X |
| −300 | | | | X | X |
| −250 | | | | | X |

In Table 3, a circle and an X are given when the line widths of the formed images are respectively below and above the projected value, too.

Figure 11:
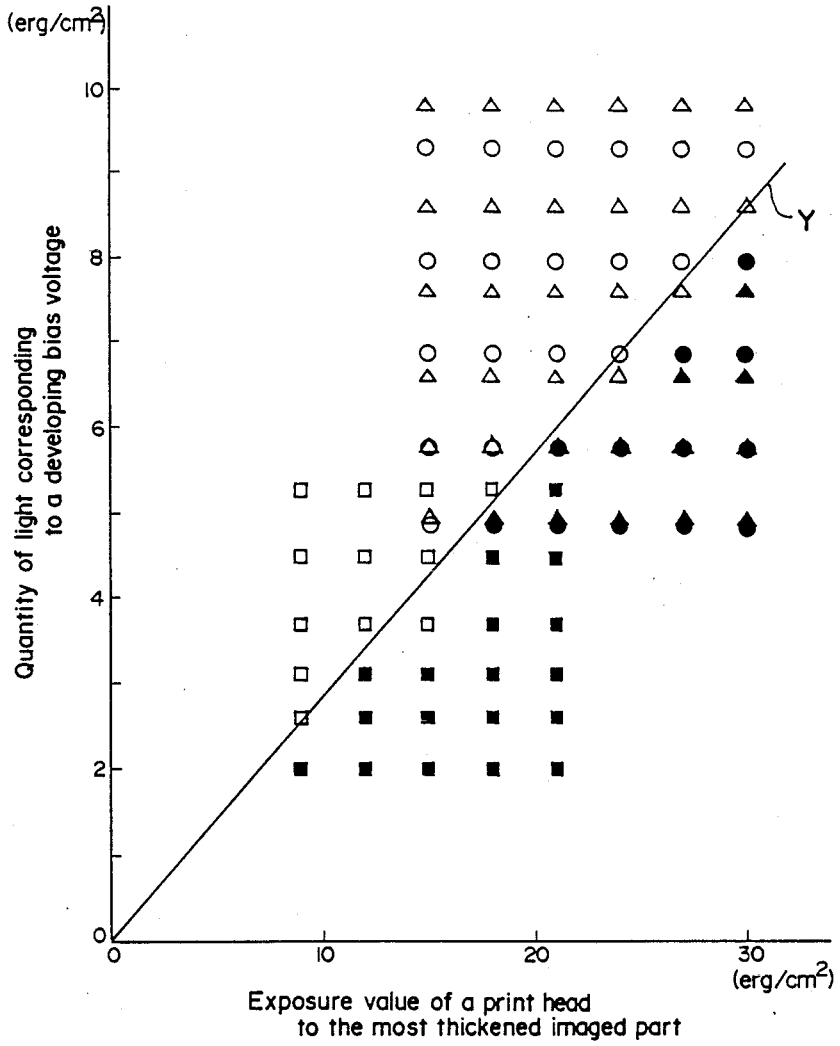
FIG. 11 is a graph showing the relation between the exposure value of a print bead and the quantity of light corresponding to a developing bias voltage.

Upon review of the results from the above three experiments, the graph shown in FIG. 11 was attained, and the results clarify that the relation between a photoinduced discharge characteristic of a photosensitive layer and a developing bias voltage (Vb) which enables a desired line widths can be commonly explained.

In FIG. 11, the x-axis shows the exposure value to the most thickened imaged part (a part in wholly black), the y-axis shows the quantity of light corresponding to the developing bias voltage (Vb). The surface potential shown in FIGS. 9 and 10 is regarded as the developing bias voltage, and the quantity of light corresponding to the developing bias voltage is gained as the quantity of light corresponding to each curve X1, X2 or X3 of the photoinduced discharge characteristic. Circles, triangles and squares correspond to the results shown in Table 1, Table 2 and Table 3 respectively. Each void mark means that the line widths of the formed images are below the projected value, and each thickened mark means that the line widths are above the projected value.

As shown by the graph in FIG. 11, it is a condition of getting the line widths of formed images below the projected value to be located above the straight line Y in the graph. That is, it is clarified that the line widths below the projected value are gained under the condition of quantity of light corresponding to $Vb \geqq (2/7)$.exposure value. This condition applies to any case without respect of altering the initial surface potential (Vo), the photoinduced discharge characteristic of the photosensitive layer and the exposure value.

Figure 12:
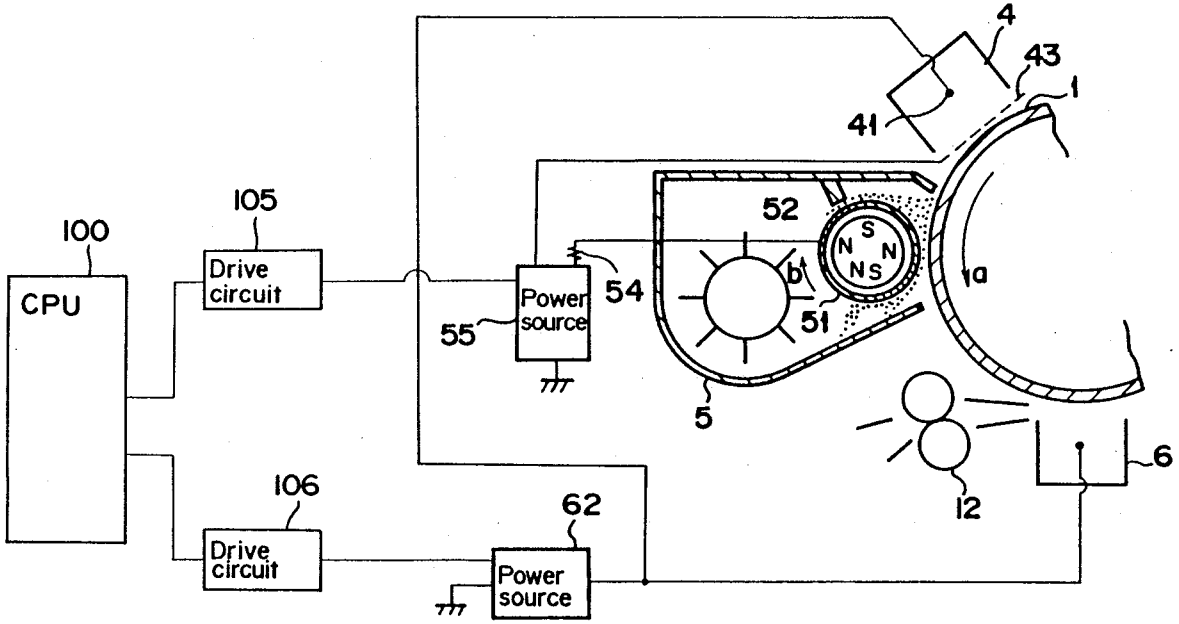
FIG. 12 shows the constitution of a principal part of a third embodiment of an image forming apparatus according to the present invention, including a control circuitry.

[Third Embodiment; refer to FIG. 12]

FIG. 12 shows the principal part of a printer according to a third embodiment of the present invention. Compared with FIG. 2, the printer used in the third embodiment has the same constitution as the printer used in the first embodiment except a power source section of the charger 4, etc.

The charge wire 41 of the scorotoron charger 4 is connected to a power source 62, and its grid 43 is connected to a power source 55. The power source 62 is also used as a power source of the transfer charger 6 and impresses the charge wire 41 with a voltage with the polarity opposite to that charged by the electric charger 2. The power source 55 is also used as a power source of a developing bias of the developing device 5 and impresses the grid 43 with a voltage with the same polarity as that charged by the electric charger 2 and a value lower than that of the surface potential of the non-imaged portions of a latent image.

The developing sleeve 51 of the developing device 5 is impressed with a developing bias voltage with the same polarity as that of the grid voltage by the power source 55. The value of the developing bias voltage, when non-magnetic insulative toner is used, is slightly lower than that of the grid voltage. For this reason, a resistor 54 is arranged between the developing sleeve 51 and the power source 55 to lower the voltage. When magnetic insulative toner is used, the value of the developing bias voltage may be equal to or above that of the grid voltage. In this case, as explained in the first embodiment, an ac can be superimposed.

The charge wire of the transfer charger 6 is impressed with a voltage with the polarity opposite to that of the insulative toner by the power source 62. Further, in this third embodiment, the charge wire 41 of the scorotoron charger 4 and the transfer charger 6 are impressed with voltages of the same potential. Accordingly, the both chargers can be directly connected to the power source 62. If each charger should be impressed with a voltage of a different potential from the other, resistors should be properly arranged to regulate the potential.

Further, the power sources 55 and 62 are controlled to be turned on and off by the microcomputer 100 through drive circuits 105 and 106 respectively. The timing of the control is the same as that shown in FIG. 5.

Figure 13:
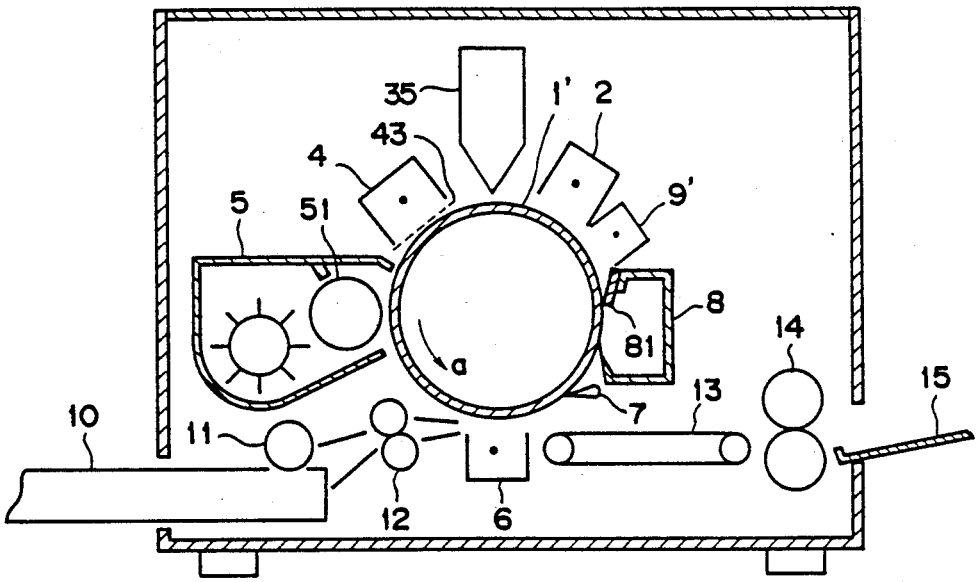
FIG. 13 is a schematic view of a fourth embodiment of an image forming apparatus according to the present invention showing its general constitution.
Figure 14A:
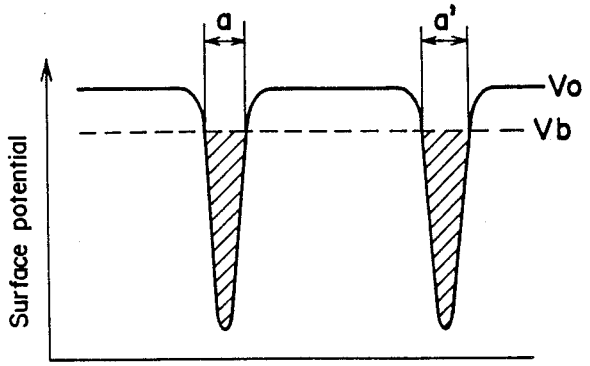
FIGS. 14*a*, 14*b* and 14*c* are charts showing the surface potential of a photosensitive layer in a conventional image forming apparatus.
Figure 14B:
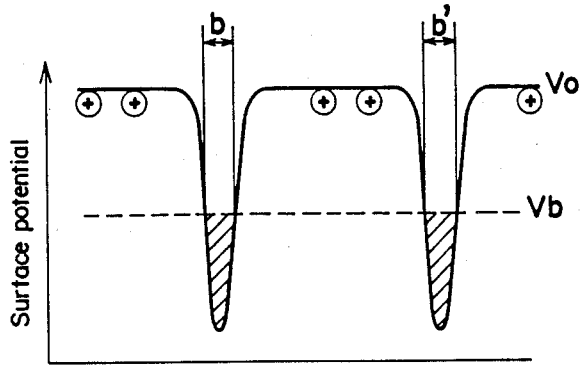
Figure 14C:
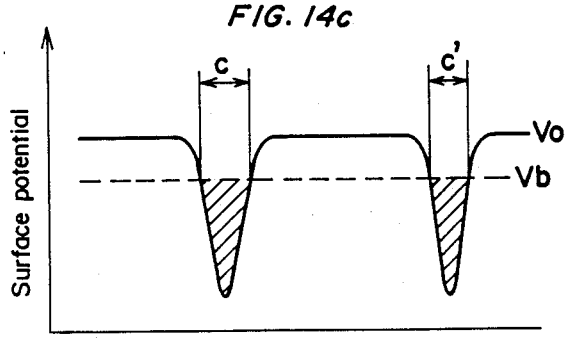

[Fourth Embodiment; refer to FIG. 13]

FIG. 13 shows a printer according to a fourth embodiment of the present invention. The differences of the printer from the one shown in FIG. 1 are that a dielectric drum 1' with a dielectric layer on its surface is used instead of the photosensitive drum 1 and that a multistylus head 35 is used as latent image forming means. The multistylus head 35 functions the same as the print head utilizing the LEDs in point of erasing the surface potential of the dielectric drum 1' in response to an image information signal to form a negative latent image consisting of non-imaged portions with the potential equal to specified surface potential and imaged portions with substantially lower potential. Since dielectric is utilized as a recording medium, a charger 9' discharging an ac is utilized as erasing means instead of the eraser lamp 9.

The procedure of forming an image, the function of the scorotoron charger 4, the operational timing, etc. are the same as those of the first embodiment, so that the detailed description of them are omitted.

Although the present invention has been described in connection with the preferred embodiments thereof, it is to be noted that various changes and modifications are apparent to those who are skilled in the art. Such changes and modifications are to be understood as included within the scope of the present invention as defined by the appended claims, unless they depart therefrom.

What is claimed is:

1. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions; and developing means for performing reversal development of the electrostatic latent image which passed through said scorotoron charger, with use of toner charged with the same polarity as that charged by said charging means, with its developing electrode impressed with a developing bias voltage with the same polarity as that charged by said charging means and a value lower than that of the surface potential of the non-imaged portions but higher than a developing threshold value.

2. An image forming apparatus as claimed in claim 1, wherein said electrostatic latent image bearing member comprises a photosensitive material.

3. An image forming apparatus as claimed in claim 2, wherein said latent image forming means is an irradiating unit for forming a negative electrostatic latent image, whose imaged portions have substantially lower surface potential, by irradiating the surface of said electrostatic latent image bearing member.

4. An image forming apparatus as claimed in claim 1, wherein said electrostatic latent image bearing member comprises a dielectric material.

5. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions; and developing means for performing reversal development of the electrostatic latent image which passed through said scorotoron charger, with use of toner charged with the same polarity as that charged by said charging means, with its developing electrode impressed with a developing bias voltage with the same polarity as that charged by said charging means and a value lower than that of the surface potential of the non-imaged portions but higher than a developing threshold value; and a single power source for impressing the grid of said scorotoron charger and the developing electrode of said developing means with a specified voltage.

6. An image forming apparatus as claimed in claim 5, wherein said electrostatic latent image bearing member comprises a photosensitive material.

7. An image forming apparatus as claimed in claim 6, wherein said latent image forming means is an irradiating unit for forming a negative electrostatic latent image, whose imaged portions have substantially lower surface potential, by irradiating the surface of said electrostatic latent image bearing member.

8. An image forming apparatus as claimed in claim 5, wherein said electrostatic latent image bearing member comprises a dielectric material

9. An image forming apparatus as claimed in claim 5, wherein said single power source includes a resistor for getting the voltage to be impressed on said developing electrode lower than the voltage to be impressed to said grid.

10. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions; and developing means for performing reversal development of the electrostatic latent image which passed through said scorotoron charger, with use of insulative magnetic toner charged with the same polarity as that charged by said charging means, with its developing electrode impressed with a developing bias voltage with the same polarity as that charged by said charging means and a value close to that of the voltage impressed on said grid.

11. An image forming apparatus as claimed in claim 10, wherein said developing bias is a specified direct current voltage or a direct current voltage superimposed with an alternating current voltage.

12. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions; and developing means for performing reversal development of the electrostatic latent image which passed through said scorotoron charger, with use of insulative non-magnetic toner charged with the same polarity as that charged said charging means, with its developing electrode impressed with a developing bias voltage with the same polarity as that charged by said charging means and a value lower than that of the voltage impressed on said grid.

13. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions;

developing means for performing reversal development of the electrostatic latent image which passed through said scorotoron charger, with use of toner charged with the same polarity as that charged by said charging means, with its developing electrode impressed with a developing bias voltage with the same polarity as that charged by said charging means and a value lower than that of the surface potential of the non-imaged portions but higher than a developing threshold value;

first control means for controlling the operation of said charging means;

second control means for controlling the operation of said scorotoron charger; and third control means for controlling said second control means to drive said scorotoron charger when a specified time elapses after said charging means was driven by said first means.

14. An image forming apparatus as claimed in claim 13, wherein said electrostatic latent image bearing member comprises a photosensitive material

15. An image forming apparatus as claimed in claim 14, wherein said latent image forming means is an irradiating unit for forming a negative electrostatic latent image, whose imaged portions have substantially lower surface potential, by irradiating the surface of said electrostatic latent image bearing member.

16. An image forming apparatus as claimed in claim 13, wherein said electrostatic latent image bearing member comprises a dielectric material.

17. An image forming apparatus as claimed in claim 13, wherein the specific time is shorter than the time required for a part of the surface of said electrostatic latent image bearing member to rotate from the position where it is charged by said charging means to the position where it is charged by said scorotoron charger.

18. An image forming apparatus as claimed in claim 17, wherein said electrostatic latent image bearing member comprises a photosensitive material.

19. An image forming apparatus as claimed in claim 18, wherein said latent image forming means is an irradiating unit for forming a negative electrostatic latent image, whose imaged portions have substantially lower surface potential, by irradiating the surface of said electrostatic latent image bearing member.

20. An image forming apparatus as claimed in claim 17, wherein said electrostatic latent image bearing member comprises a dielectric material.

21. An image forming apparatus comprising:

an electrostatic latent image bearing member which is arranged to rotate in one direction;

charging means for charging the surface of said electrostatic latent image bearing member with specified surface potential and polarity;

latent image forming means for forming a negative electrostatic latent image, which consists of non-imaged portions with the potential equal to the specified surface potential and imaged portions with substantially lower surface potential, on the surface of said electrostatic latent image bearing member which was charged with the specified surface potential by said charging means;

a scorotoron charger for charging the surface of said electrostatic latent image bearing member on which an electrostatic latent image has just been formed with the polarity opposite to that charged by said charging means in order to reduce the surface potential of the non-imaged portions, with its grid impressed with a voltage with the same polarity as that charged by said charging means and a value lower than that of the surface potential of the non-imaged portions, said grid being composed of a plurality of wires aligned at a specified pitch, and the proximate distance between the surface of said electrostatic latent image bearing member and said grid being designed smaller than the pitch among the wires of said grid; and developing means for performing reversal development of the electrostatic latent image which passed through said scorotoron charger, with use of toner charged with the same polarity as that charged by said charging means, with its developing electrode impressed with a developing bias voltage with the same polarity as that charged by said charging means and a value lower than that of the surface potential of the non-imaged portions but higher than a developing threshold value.

22. An image forming apparatus as claimed in claim 21, wherein said electrostatic latent image bearing member comprises a photosensitive material.

23. An image forming apparatus as claimed in claim 22, wherein said latent image forming means is an irradiating unit for forming a negative electrostatic latent image, whose imaged portions have substantially lower surface potential, by irradiating the surface of said electrostatic latent image bearing member.

24. An image forming apparatus as claimed in claim 21, wherein said electrostatic latent image bearing member comprises a dielectric material.

25. An image forming apparatus as claimed in claim 21, wherein the proximate distance (Dg) between the grid of said scorotoron charger and the surface of said electrostatic latent image bearing member and the wire pitch (Mp) of said grid fulfill the following conditions:

$$Dg \leqq 0.8 \text{ mm}$$

$$0.25\ mm < Mp \leqq 1.25 \times Dg$$

26. An image forming apparatus as claimed in claim 25, wherein said electrostatic latent image bearing member comprises a photosensitive material.

27. An image forming apparatus as claimed in claim 26, wherein said latent image forming means is an irradiating unit for forming a negative electrostatic latent image, whose imaged portions have substantially lower surface potential, by irradiating the surface of said electrostatic latent image bearing member.

28. An image forming apparatus as claimed in claim 25, wherein said electrostatic latent image bearing member comprises a dielectric material.

29. An image forming apparatus comprising:

a photosensitive layer which is arranged to rotate in one direction and has a specified photoinduced discharge characteristic;

charging means for charging the surface of said photosensitive layer with specified surface potential and polarity;

irradiating means for forming a negative electrostatic latent image consisting of non-imaged portions with the polarity equal to the specified surface potential and imaged portions with substantially lower surface potential on said photosensitive layer, by irradiating said photosensitive layer which was charged by said charging means with the specified surface potential at a specified exposure value;

a scorotoron charger for charging the surface of said photosensitive layer on which an electrostatic latent image has just been formed with the polarity opposite to that charged by said charging means in order to reduce the surface potential of said non-imaged portions, with its grid impressed with a voltage with the same polarity as that charged by said charging means and a value lower than that of the surface potential of the non-imaged portions; and developing means for performing reversal development of the electrostatic latent image which passed through said scorotoron charger, with use of toner charged with the same polarity as that charged by said charging means, with its developing electrode impressed with a developing bias voltage with the same polarity as that charged by said charging means, said developing bias voltage corresponding to surface potential of said photosensitive layer which will be attained if said photosensitive layer is irradiated at a certain quantity of light lower than said specified exposure value in reference to the characteristic curve showing the relation between the surface potential of said photosensitive layer and the quantity of light irradiated from said irradiating means based on the photoinduced discharge characteristic of said photosensitive layer.

30. An image forming apparatus as claimed in claim 29, wherein said developing bias voltage corresponds to surface potential of said photosensitive layer which will be attained if said photosensitive layer is irradiated at a certain quantity of light higher than the value of approximately two seventh of said specified exposure value in reference to the characteristic curve showing the relation between the surface potential of said photosensitive layer and the quantity of light irradiated from said irradiating means based on the photoinduced discharge characteristic of said photosensitive layer.

* * * * *

UNITED STATES PATENT AND TRADEMARK OFFICE

CERTIFICATE OF CORRECTION

PATENT NO. : 4,954,843

DATED : September 4, 1990

INVENTOR(S) : Tateki OKA, et al.

It is certified that error appears in the above-identified patent and that said Letters Patent is hereby corrected as shown below:

ON THE TITLE PAGE

[30] Third item in Priority information changed to:

Apr. 11, 1989 [JP] Japan ..... 64-92383

Signed and Sealed this

Twenty-sixth Day of November, 1991

*Attest:*

HARRY F. MANBECK, JR.

*Attesting Officer*

*Commissioner of Patents and Trademarks*